US009668059B2

(12) United States Patent
Li

(10) Patent No.: US 9,668,059 B2
(45) Date of Patent: May 30, 2017

(54) MODULAR SPEAKER COMPONENT

(71) Applicant: TGI Technology Private Limited, Singapore (SG)

(72) Inventor: Shihuang Li, Singapore (SG)

(73) Assignee: TGI Technology Private Limited, Singapore (SG)

( * ) Notice: Subject to any disclaimer, the term of this patent is extended or adjusted under 35 U.S.C. 154(b) by 105 days.

(21) Appl. No.: 14/390,398

(22) PCT Filed: Mar. 22, 2013

(86) PCT No.: PCT/SG2013/000116
§ 371 (c)(1),
(2) Date: Oct. 3, 2014

(87) PCT Pub. No.: WO2013/162467
PCT Pub. Date: Oct. 31, 2013

(65) Prior Publication Data

US 2015/0181342 A1 Jun. 25, 2015

(30) Foreign Application Priority Data

Apr. 28, 2012 (CN) ..... 2012 1 0131536

(51) Int. Cl.
*H04R 9/06* (2006.01)
*H04R 7/20* (2006.01)
(Continued)

(52) U.S. Cl.
CPC ..... *H04R 7/20* (2013.01); *H04R 1/24* (2013.01); *H04R 1/2834* (2013.01)

(58) Field of Classification Search
USPC ..... 381/335
See application file for complete search history.

(56) References Cited

U.S. PATENT DOCUMENTS 2,915,588 A * 12/1959 Bose ..... H04R 1/403 181/147
5,848,173 A * 12/1998 Sato ..... H04R 7/18 181/171

(Continued)

FOREIGN PATENT DOCUMENTS

WO 2011126034 A1 10/2011

OTHER PUBLICATIONS

International Search Report and Written Opinion.

*Primary Examiner* — Amir Etesam
(74) *Attorney, Agent, or Firm* — Hayes Soloway PC

(57) ABSTRACT

This invention discloses a kind of modular speaker component. A characteristic is that it includes a fixed part. This fixed part has a thin-walled structure. An active loudspeaker unit and passive diaphragm units are installed on it. Another characteristic is that it includes a sealed connection part. This sealed connection part is fixed on the said fixed part and it has sealing material; the said sealed connection part aligns, connects and secures the said fixed part to the opening of a rigid container. This causes the said fixed part and the rigid container to jointly form an airtight resonant space. The fixed part integrates the active loudspeaker unit and passive diaphragm units on top and combines with the sealed connection part fixed on it to form overall a universal high sound quality module that is unaffected by the rigid container. In a plan based on a small volume, it can also exhibit outstanding performance at medium and low frequencies; it can very conveniently form a complete high performance speaker with the rigid container, and satisfy the shape constraint requirements for the speaker in various application environments with different styles.

12 Claims, 8 Drawing Sheets

(51) Int. Cl.
*H04R 1/24* (2006.01)
*H04R 1/28* (2006.01)

(56) References Cited

U.S. PATENT DOCUMENTS

| | | | | |
|---|---|---|---|---|
| 7,974,431 | B2 * | 7/2011 | Saiki | H04R 1/2834 381/338 |
| 9,008,342 | B1 * | 4/2015 | Hagman | H04R 1/44 381/334 |
| 2004/0251079 | A1 | 12/2004 | Plummer | |
| 2005/0087392 | A1 | 4/2005 | Flanders et al. | |
| 2006/0078144 | A1 * | 4/2006 | Stiles | H04R 1/02 381/335 |
| 2007/0291965 | A1 | 12/2007 | Noro et al. | |
| 2009/0279716 | A1 * | 11/2009 | Stahl | B06B 1/18 381/111 |
| 2013/0028458 | A1 | 1/2013 | Suzuki et al. | |

* cited by examiner

MODULAR SPEAKER COMPONENT

CROSS-REFERENCE TO RELATED APPLICATIONS

This is a U.S. national stage application of the International Patent Application No. PCT/SG2013/000116, filed 22 Mar. 2013, which claims priority to Chinese Patent Application No. 201210131536.8, filed 28 Apr. 2012, both of which are incorporated herein by reference in their entirety.

FIELD OF THE INVENTION

This invention involves the modular component of a kind of modular speaker.

BACKGROUND OF THE INVENTION

As a piece of electric-acoustic conversion equipment, the speaker has a wide variety of forms. Particularly for some special venues, the speaker cannot be made too big after taking into consideration factors such as structure and appearance. Further, due to constraints, it cannot simply be placed in the environment to stick out all alone. And so, the form of the speaker body should be made such that it is similar to the environmental elements. Such special venues are very varied and they can range from e.g. museums to exhibition halls to bedrooms to retail stores. The styles are diverse and the differences are obvious. A very large proportion of speakers have custom structures so uniformity is hard. It is difficult to satisfy modular application for batch production and standardization.

The easiest way to handle this is to simply load the loudspeakers in several sealed rigid containers. These rigid containers would be the environmental elements themselves and they would allow the actual speaker body to be concealed. The drawback of this method is the difficulty in ensuring the sound quality of the speaker, particularly at medium and low frequencies. And so, the challenge is to design the speaker in a modular manner while ensuring that it has considerable versatility and high quality sound effects.

SUMMARY OF THE INVENTION

In view of the above problem of ensuring both versatility and high quality sound effects for the speaker, this invention proposes a kind of universal modular speaker component. The technical plan is as follows:

The modular speaker component includes:

a fixed part—this fixed part has a thin-walled structure. An active loudspeaker unit and passive diaphragm units are installed on it; the said active loudspeaker unit and passive diaphragm units are sealed at the installation portion of the said fixed part; and a sealed connection part—this sealed connection part is fixed on the said fixed part and it extends along the latter. Its edge is a continuous sealed line and there is sealing material set on this edge. This causes the said sealed connection part to form a sealed state with other rigid containers or surfaces.

Below are several preferred improvements for this technical plan.

In a preferred embodiment, the said sealed connection part uses the said sealing material to align, connect and secure the said fixed part to the opening of a rigid container. This causes the said fixed part and the rigid container to jointly form a resonant space. On this basis, there can be three improvements: For the first improvement, the projection locations of the said active loudspeaker unit and passive diaphragm units on the opening of the said rigid container are entirely located within the largest outer diameter of the said sealed connection part. For the second improvement, the said active loudspeaker unit has a back loaded form relative to the said resonant space. For the third improvement, the said rigid container is a sealed speaker with a phase inversion device. The said phase inversion device refers to any phase inverter tube, labyrinth path, horn path or arbitrary combination of the three.

In a preferred embodiment, the said passive diaphragm units and the said active loudspeaker unit are oriented toward the device. Further, the said passive diaphragm units are distributed at the periphery of the said active loudspeaker unit. The following improvement can be made on the basis of this plan: The said passive diaphragm units use at least one ring-shaped structure at the said fixed part. The part within their inner ring is filled by the said active loudspeaker unit; their outer ring reaches the said sealed connection part.

In a preferred embodiment, the vibration directions of the said passive diaphragm units all intersect the central axis of the said fixed part; the said active loudspeaker unit and the said passive diaphragm units are all rotationally symmetric around the central axis of the said fixed part; the said passive diaphragm units are distributed at the periphery of the said active loudspeaker unit. Further, in another preferred embodiment, the said passive diaphragm units are entirely rotationally symmetric. They also take up the side area of the said fixed part.

In a preferred embodiment, the said fixed part, sealed connection part and passive diaphragm units have an integrated molded structure.

In a preferred embodiment, the said sealed connection part is fixed on a rigid container with adjustable volume using the said sealing material.

In a preferred embodiment, the said sealing material forms a flat opening shape. Through the weight of the entire component itself, it is placed on a certain horizontal surface to make up a sealed form.

In a preferred embodiment, the said active loudspeaker unit, passive diaphragm units, sealed connection part and sealing material are all located on the same flat surface; further, the said sealing material is fitted tightly to the installation hole of a sealed container. The entire component thus constitutes an embedded form.

The beneficial effects of this invention are:

1. The fixed part integrates the active loudspeaker unit and passive diaphragm units on top and combines with the sealed connection part fixed on it to form overall a universal high sound quality module that is unaffected by the rigid container. In a plan based on a small volume, it can also exhibit outstanding performance at medium and low frequencies; it can very conveniently form a complete high performance speaker with the rigid container, and satisfy the shape constraint requirements for the speaker in various application environments with different styles.

2. The central axis of the active loudspeaker unit is located in the central axis of the fixed part. The passive diaphragms are rotationally symmetric around this central axis. This allows the entire speaker to maintain stability along the central axis of the fixed part, particularly when the central axis of the fixed part is perpendicular to the device.

3. The vibration directions of the passive diaphragm units adopt the method of all having the same direction as the central axis of the fixed part. This causes the coloration to be relatively low for the entire fixed part. There are also fewer harmonic waves and the sound quality is purer. At the same time, this method reduces the additional vibration caused by the form change of the air within the resonant space. On the one hand, it can prevent as much as possible the damage caused by the unbalanced vibration of the rigid container. On the other hand, it will not cause too much tangential vibration. The speaker will then not require too many securing mechanisms and securing can be done by means of simple placement. Therefore, the speaker will be even less constrained by external air form, structure, securing, etc.

4. The active loudspeaker unit uses the back loading method relative to the resonant space. This allows the loudspeaker frame and other components to be concealed and protected.

5. The projection locations of the active loudspeaker unit and passive diaphragm units on the opening of the rigid container are entirely located within the largest outer diameter of the sealed connection part. This allows the fixed part, as well as all the above components, to fit within the opening of the rigid container. Based on requirements, concealment can be done for the necessary depth. These parts can be made more concealed and unexposed, and the appearance will be unaffected.

6. The vibration directions of all the passive diaphragm units intersect the central axis of the fixed part. Further, the sum of all the passive diaphragm components perpendicular to the central axis of the fixed part is zero; this setup causes the tangential vibration for the entire speaker in the horizontal direction to achieve balance during operation. This greatly weakens the horizontal shifting of the speaker body during large movements. It makes the speaker body more stable and also lowers the coloration.

7. The form of the passive diaphragm units is a ring-shaped structure. The part within the inner ring is filled by the active loudspeaker unit; the outer ring reaches the sealed connection part. Such a form allows the entire fixed part to obtain maximum use, such that its effective vibration area is the largest. It has outstanding performance at low frequencies and the coloration is minimized at the same time too.

BRIEF DESCRIPTION OF THE DRAWINGS

The following figures and embodiments provide further explanation for this invention.

DETAILED DESCRIPTION OF THE INVENTION

Figure 1:
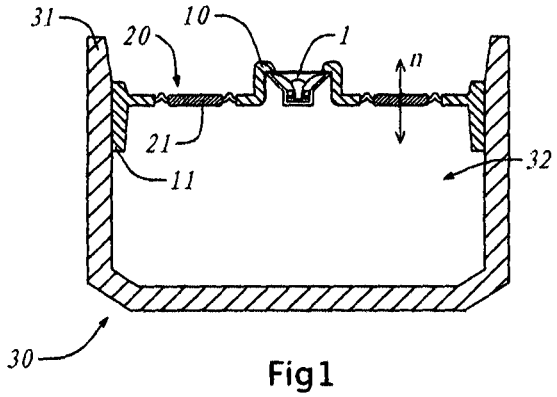
FIG. 1 is the side cutaway view diagram for the use of embodiment 1 of this invention on a groove-shaped container.
Figure 2:
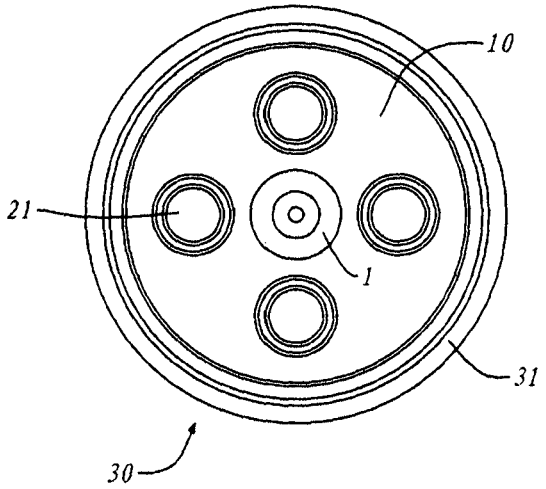
FIG. 2 is the schematic top view diagram for the embodiment shown in FIG. 1.

Embodiment 1:

As per FIG. 1, the side cutaway view diagram for the use of embodiment 1 of this invention on a ceramic groove-shaped container; FIG. 2 is the schematic top view diagram for the embodiment shown in FIG. 1; the following explanation for embodiment 1 of this invention is with reference to these two diagrams.

Fixed part 10 has a disc-shaped thin-walled structure. A moving coil type active loudspeaker unit 1 is loaded at its center. Its cone hole faces upward; four passive diaphragm units 20 are distributed at the periphery of active loudspeaker unit 1 which is on top of fixed part 10. Fixed part 10 forms a circle together with sealed connection part 11 at its periphery. Using the plugging method, it is secured within opening 31 of rigid container 30. Further, the central axis of fixed part 10 and the central axis of active loudspeaker unit 1 are the same; also, the four passive diaphragm units 20 are rotationally symmetric around the aforementioned central axis. In particular, the vibration directions n of the four passive diaphragm units 20 is the same as the direction of this central axis. Sealed connection part 11 is located at the outermost edge of fixed part 10. There is sealing material where it comes in contact with opening 31. The entire fixed part 10 and rigid container 30 together form an airtight resonant space 32.

When active loudspeaker unit 1 starts to operate, its cone will drive the air within resonant space 32 to change its form. This will thus cause diaphragms 21 on passive diaphragm units 20 to resonate such that all the audio frequency vibration is generated from active loudspeaker unit 1 and the four passive diaphragm units. An improved sound quality is thus obtained.

As can be seen, fixed part 10 integrates active loudspeaker unit 1 and passive diaphragm units 20, and combines with the sealed connection part 11 fixed on it to form overall a universal high sound quality module that is unaffected by rigid container 30. In a plan based on a small volume, it can also exhibit outstanding performance at medium and low frequencies; it can very conveniently form a complete high performance speaker with rigid container 30, and satisfy the shape constraint requirements for the speaker in various application environments with different styles. This presents an updated design method: Active loudspeaker unit 1 and passive diaphragm units 20 can be individually designed and tuned to form a modular component. This will greatly reduce the constraints for the speaker body (rigid container portion). In so doing, the structural design and appearance design can also be more proactive, and the sound quality effect will also not be lowered. By providing post-tuning module data, it can become a kind of universal module. This allows a greater degree of freedom within a certain range for the design of the speaker body. This is different from the traditional design method where priority must be given to the design of the speaker body.

On the other hand, the central axis of active loudspeaker unit 1 is located in the central axis of fixed part 1. The passive diaphragms 20 are rotationally symmetric around this central axis. This allows the entire speaker to maintain stability along the central axis of fixed part 1, particularly when the central axis of fixed part 1 is perpendicular to the device. The vibration directions of passive diaphragm units 20 adopt the method of all having the same direction as the central axis of fixed part 1. This causes the coloration to be relatively low for the entire fixed part 1. There are also fewer harmonic waves and the sound quality is purer. At the same time, this method reduces the additional vibration caused by the form change of the air within resonant space 32. On the one hand, it can prevent as much as possible the damage caused by the unbalanced vibration of the rigid container. On the other hand, it will not cause too much tangential vibration. The speaker will then not require too many securing mechanisms and securing can be done by means of simple placement. Therefore, the speaker will be even less constrained by external air form, structure, securing, etc.

Active loudspeaker unit 1 in this embodiment 1 uses the back loading method relative to resonant space 32. This allows the loudspeaker frame and other components to be concealed and protected. At the same time, the projection locations of active loudspeaker unit 1 and passive diaphragm units 20 on the opening of rigid container 30 are entirely located within the largest outer diameter of sealed connection part 11. This allows fixed part 10, as well as all the above components, to fit within the opening of rigid container 30. Based on requirements, concealment can be done for the necessary depth. These parts can be made more concealed and unexposed, and the appearance will be unaffected.

Figure 3:
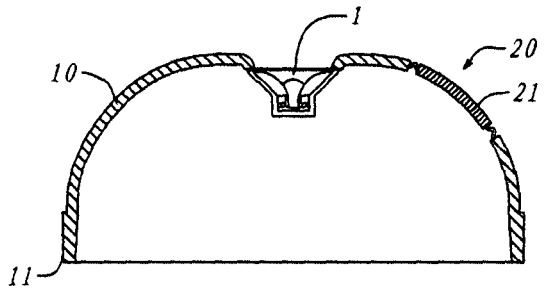
FIG. 3 is the side cutaway view diagram for embodiment 2 of this invention.
Figure 4:
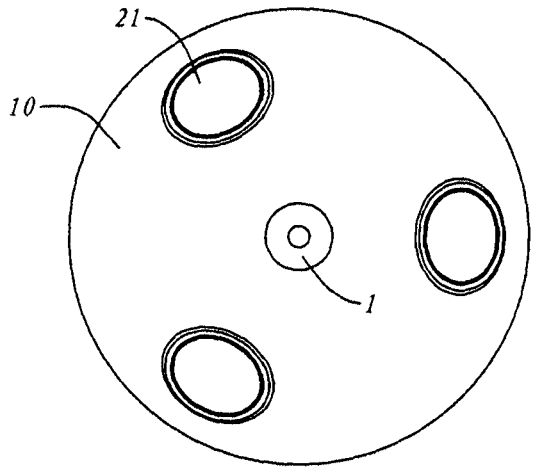
FIG. 4 is the schematic top view diagram for the embodiment shown in FIG. 3.
Figure 5:
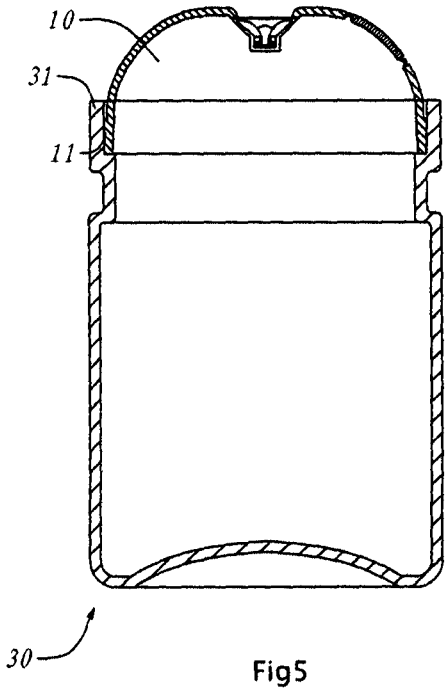
FIG. 5 is the schematic cutaway view diagram for the use of the embodiment shown in FIG. 3 on a standard glass jar.

Embodiment 2:

As per FIG. 3, the side cutaway view diagram for embodiment 2 of this invention; FIG. 4 is the schematic top view diagram for the embodiment shown in FIG. 3; FIG. 5 is the schematic cutaway view diagram for the use of the embodiment shown in FIG. 3 on a standard glass jar; the following explanation for this embodiment 2 is with reference to these three diagrams.

In this embodiment 2, there are three passive diaphragm units 20. Like embodiment 1, they are rotationally symmetric relative to active loudspeaker unit 1 that has the same central axis as fixed part 10; the vibration directions of all the passive diaphragm units 20 intersect the central axis of fixed part 10; further, the sum of all the passive diaphragm 20 components perpendicular to the central axis of fixed part 10 is zero; this setup causes the tangential vibration for the entire speaker in the horizontal direction to achieve balance during operation. This greatly weakens the horizontal shifting of the speaker body during large movements. It makes the speaker body more stable and also lowers the coloration. For this embodiment 2, the sealed connection part 11 can fit within rigid container 30 that is an 86 mm glass jar. This is a relatively universal plan.

There are three passive diaphragm units 20. This allows sufficiently uniform vibration for the vibration-capable surface of the entire fixed part 10. The complexity will also not be too high.

Figure 6:
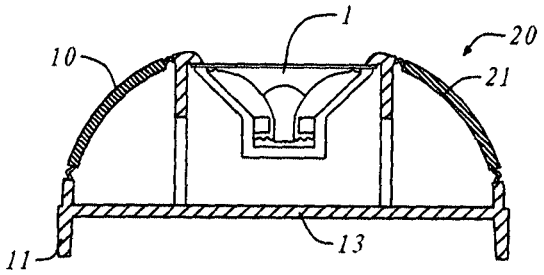
FIG. 6 is the side cutaway view diagram for embodiment 3 of this invention.
Figure 7:
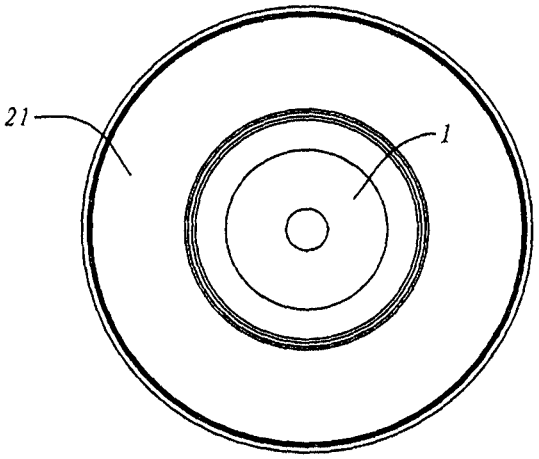
FIG. 7 is the top view diagram for the embodiment shown in FIG. 6.

Embodiment 3:

As per FIG. 6, the side cutaway view diagram for embodiment 3 of this invention; FIG. 7 is the top view diagram for the embodiment shown in FIG. 6; the following explanation for embodiment 3 is with reference to these two diagrams.

The form of fixed part 10 for this embodiment 3 is similar to that for embodiment 2. It is an upward protruding structure; active loudspeaker unit 1 is still located at the central axis of fixed part 10 and the back loading method is used. The difference is that the form of passive diaphragm units 20 is a ring-shaped structure. The part within the inner ring is filled by active loudspeaker unit 1; the outer ring reaches sealed connection part 11. Such a form allows the entire fixed part 10 to obtain maximum use, such that its effective vibration area is the largest. It has outstanding performance at low frequencies and the coloration is minimized at the same time too. In particular, a plan using such kind of ring-shaped passive diaphragm units 20 allows the utilization of thinner loudspeakers. It is suitable to be used for environments where the space thickness is relatively small. To achieve this form, fixed part 10 requires a support frame 13 to properly secure active loudspeaker unit 1 and passive diaphragm units 20.

Figure 8:
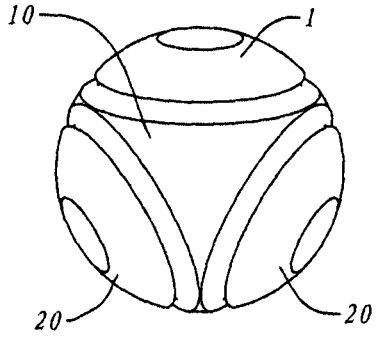
FIG. 8 is the schematic top view diagram for embodiment 4 of this invention.
Figure 9:
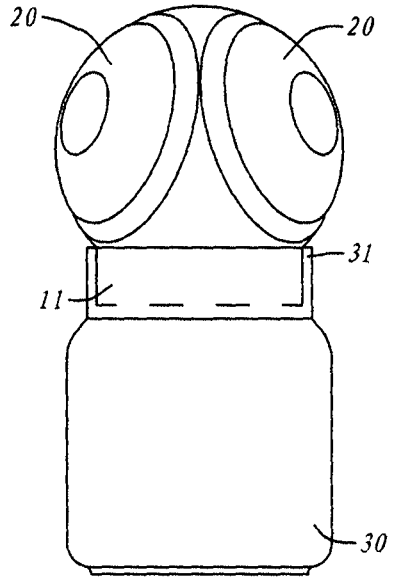
FIG. 9 is the schematic side view diagram for the use of the embodiment shown in FIG. 8 on a glass jar.

Embodiment 4:

As per FIG. 8, the schematic top view diagram for embodiment 4 of this invention; FIG. 9 is the schematic side view diagram for the use of the embodiment shown in FIG. 8 on a glass jar; the following explanation for embodiment 4 of this invention is with reference to these two diagrams.

In this embodiment 4, fixed part 10 is a spherical shape overall. As for active loudspeaker unit 1 and the two passive diaphragm units 20 with the same appearance, they are distributed around the central axis of fixed part 10 in a rotationally symmetric manner. Further, the vibration directions of active loudspeaker unit 1 and passive diaphragm units 20 intersect the central axis of fixed part 10. This method allows the form of the fixed part to be simple. It also causes the vibration to be balanced. Through sealed connection part 11, fixed part 10 is plugged and secured to opening 31 of glass jar 30.

Figure 10:
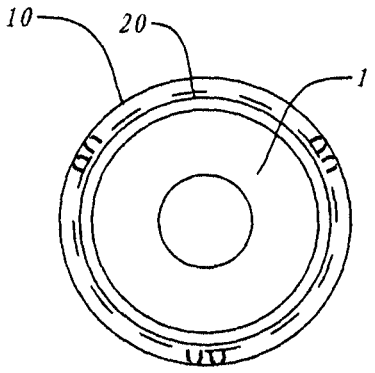
FIG. 10 is the schematic top view diagram for embodiment 5 of this invention.
Figure 11:
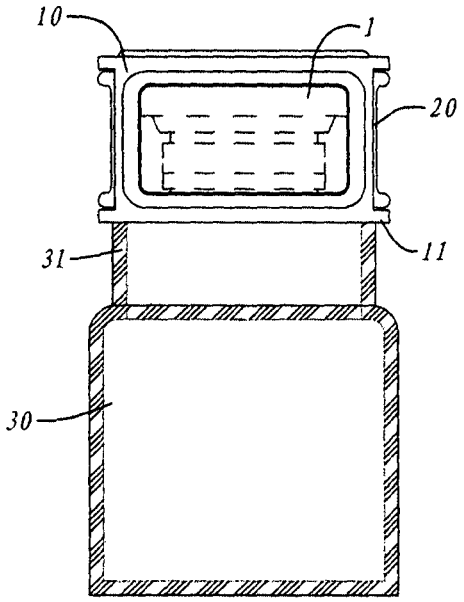
FIG. 11 is the schematic side view diagram for the use of the embodiment shown in FIG. 10 on a glass jar.

Embodiment 5:

As per FIG. 10, the schematic top view diagram for embodiment 5 of this invention; as per FIG. 11, the schematic side view diagram for the use of the embodiment shown in FIG. 10 on a glass jar. The following explanation is with reference to these two diagrams.

Active loudspeaker unit 1 occupies the top area of fixed part 10. At the same time, passive diaphragm units 20 are distributed at the side of fixed part 10 while being rotationally symmetric around the central axis of active loudspeaker unit 1; sealed connection part 11 is located at the opposite end of active loudspeaker unit 1. At the same time, all the passive diaphragm units 20 are rotationally symmetric and they occupy the side area of fixed part 10. This kind of method also fully utilizes the surface area of fixed part 10 and maximizes the vibration-capable portion. This substantially improves the sound effect at medium and low frequencies, and it further prevents coloration. In particular, it is easy to make components of such form into standard parts for production and popularization. Due to the sealing material of the rigid container, it has a flat opening form. This allows the entire component to be placed flat on a level surface such that sealing is sufficient and normal usage is possible; similarly, sealed connection part 11 is secured on a rigid container with adjustable volume. Convenience can be achieved and the effect of rigid container 30 is almost negligible. There is thus good applicability. For this type of embodiment, its sealed connection part 11 can be adjusted for the corresponding audio effects at low frequencies to satisfy different requirements.

Figure 12:
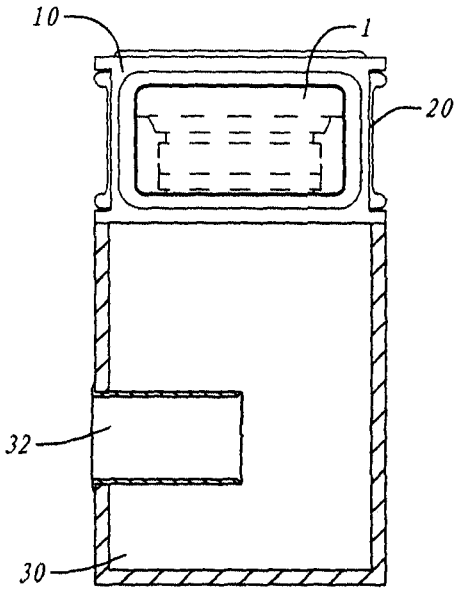
FIG. 12 is the sectional schematic side view diagram for embodiment 6 of this invention.

Embodiment 6:

As per FIG. 12, the sectional schematic side view diagram for embodiment 6 of this invention. Compared with embodiment 5, the module's fixed part 10, active loudspeaker unit 1 and passive diaphragm units 20 are similar. The difference is that this embodiment is used on a rigid container 30 with phase inverter tube 32; coupled with this phase inverter tube 32, the performance for the entire speaker at low frequencies can be significantly improved. The original lower limit for low frequencies was 70-80 Hz. Now, it can be as low as around 50 Hz. This is a preferred embodiment. In particular, fixed part 10 and passive diaphragm units 20 of this embodiment use an integrated molded structure. This makes processing simple for the components and provides good airtightness too; the diaphragms of the passive diaphragm units 20 as well as the elastic medium all use rubber material. Treatment is done for their thicknesses and surfaces such that they can be integrated. During actual debugging, various matching weights can also be added onto the passive diaphragm units 20 to achieve different resonance effects.

Figure 13:
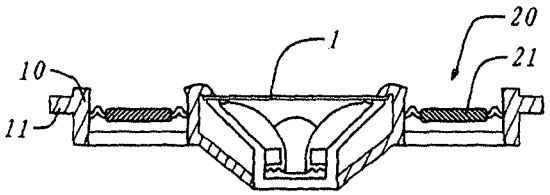
FIG. 13 is the side cutaway view diagram for embodiment 7 of this invention.
Figure 14:
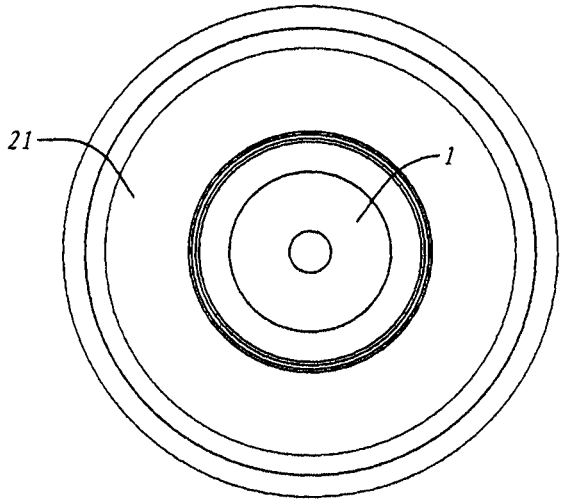
FIG. 14 is the top view diagram for embodiment 7 shown in FIG. 13.

Embodiment 7:

FIG. 13 is the side cutaway view diagram for embodiment 7 of this invention; FIG. 14 is the top view diagram for embodiment 7 shown in FIG. 13; there are similarities between this embodiment and embodiment 3: The form of passive diaphragm units 20 and their diaphragms 21 is a ring-shaped structure. The part within the inner ring is filled by active loudspeaker unit 1; the outer ring reaches sealed connection part 11. In particular, passive diaphragms 20 have a flat form and they jointly form an embedded type module with active loudspeaker unit 1. Their sealed connection part 11 and fixed part 10 use the same material. Sealed connection part 11 has sealing effect itself and it possesses the same capability as the sealing material. It is used in conjunction with the similar sealing material on the rigid container. The cone diameter of active loudspeaker unit 1 is 5 inches and the outer diameter of the diaphragms 21 is 10 inches.

Figure 15:
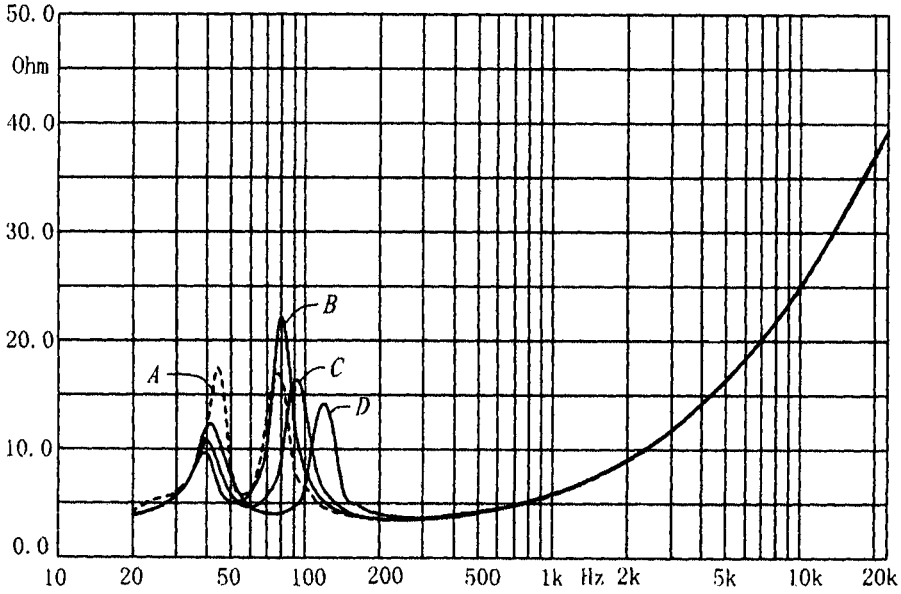
FIG. 15 is the impedance curve diagram for the use of the embodiment shown in FIG. 14 on four kinds of rigid containers with different volumes.

FIG. 15 is the impedance curve diagram for the use of the embodiment shown in FIG. 14 on four kinds of rigid containers with different volumes.

For the use of this embodiment on four different rigid containers, the containers are represented on the impedance curve diagram as the four curves of A, B, C and D: These four curves correspond to the four rigid containers of respective volumes 18122, 5263, 3649 and 2197 cm3. As can be seen, no matter how the volume changes, the peak value can be maintained near the frequencies of 50 Hz and 100 Hz. At these frequencies, there is more stable impedance. The change in volume causes slight displacement for the peak value. However, it is a stable trend within 30-200 Hz; on the other hand, when the volume is relatively large, such as the state for A, the peak value is relatively concentrated and obvious. There is good performance at low frequencies. As can be seen, the performance of the module at low frequencies is not constrained by the rigid container. It is not much constrained by the speaker body and this greatly facilitates the design of the speaker body.

The description above only covers the preferred embodiments of this invention and it is not meant to limit its implementation scope i.e. any equivalent changes or modifications made within the patent scope of this invention or based on its specification content should all fall within the scope of this invention.

The invention claimed is:

1. A modular speaker component comprising:

a thin-walled fixed part including an active loudspeaker unit and at least one passive diaphragm unit, wherein a central axis of the active loudspeaker unit and a central axis of the fixed part are co-linear and wherein each passive diaphragm unit of the at least one passive diaphragm unit is disposed rotationally symmetrically around the central axis of the active loudspeaker; and a sealable connection part fixed to an entire outer perimeter of the fixed part, wherein the sealed connection part includes a continuous edge including a sealing material and wherein the sealable connection part is adapted to form an air-tight seal between the fixed part and one of a rigid container and a rigid surface, wherein sealing material of the sealable connection part is adapted to align, connect and secure the fixed part to an opening of the rigid container, thereby forming a resonant space between the fixed.

2. The modular speaker component of claim 1, further comprising the rigid container including a phase inversion device and wherein the phase inversion device includes one of a phase inverter tube, a labyrinth path and a horn.

3. The modular speaker component of claim 1, wherein the at least one passive diaphragm unit and the active loudspeaker unit are oriented toward the device and wherein each of the at least one passive diaphragm units is distributed at a periphery of the active loudspeaker unit.

4. The modular speaker component of claim 3, wherein the at least one passive diaphragm unit includes a ring-shaped structure having an inner ring and an outer ring and wherein the at least one passive diaphragm unit contacts the active loudspeaker unit at the inner ring and contacts the sealable connection part at the outer ring.

5. The modular speaker component of claim 1, wherein vibration directions of each of the at least one passive diaphragm units all intersect the central axis of the fixed part;

wherein the active loudspeaker unit and a plurality of diaphragm units of the at least one passive diaphragm units are rotationally symmetric around the central axis of the fixed part; and wherein the plurality of passive diaphragm units is distributed peripherally outboard of the active loudspeaker unit.

6. The modular speaker component of claim 5, wherein the plurality of passive diaphragm units are entirely rotationally symmetric about the central axis of the fixed part and are disposed at side areas of the fixed part.

7. The modular speaker component of claim 1, wherein the active loudspeaker unit and each of the at least one passive diaphragm units are disposed entirely within a largest outer diameter of the sealable connection part.

8. The modular speaker component of claim 1, wherein the active loudspeaker unit has a back loaded form relative to the resonant space.

9. The modular speaker component of claim 1, wherein the fixed part, the sealable connection part and each of the at least one passive diaphragm units together form an integrated, molded structure.

10. The modular speaker component of claim 1, further comprising a rigid container with adjustable volume, wherein the sealable connection part is fixed on the rigid container using the sealing material.

11. The modular speaker component of claim 1, wherein the sealing material forms a flat opening shape and wherein the entire modular speaker component is adapted to form an air tight seal with a horizontal surface due to a mass of the modular speaker component when disposed on the horizontal surface.

12. The modular speaker component of claim 1, further comprising a sealed container, wherein each of the active loudspeaker unit, the at least one passive diaphragm unit, the sealed connection part and the sealing material are all substantially disposed in a planar surface, and wherein the sealing material is fitted tightly to an installation hole of the sealed container.

* * * * *